US008038141B2

(12) United States Patent
Matsushima

(10) Patent No.: US 8,038,141 B2
(45) Date of Patent: Oct. 18, 2011

(54) DOCUMENT FEEDER AND IMAGE SCANNING DEVICE PROVIDED WITH THE SAME

(75) Inventor: Ryoichi Matsushima, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 116 days.

(21) Appl. No.: 12/402,527

(22) Filed: Mar. 12, 2009

(65) Prior Publication Data

US 2009/0243189 A1 Oct. 1, 2009

(30) Foreign Application Priority Data

Mar. 25, 2008 (JP) ..... 2008-078622

(51) Int. Cl.
*B65H 5/00* (2006.01)

(52) U.S. Cl. ..... 271/10.11; 271/121

(58) Field of Classification Search ..... 271/10.09, 271/10.11, 121

See application file for complete search history.

(56) References Cited

U.S. PATENT DOCUMENTS

| | | | | |
|---|---|---|---|---|
| 5,052,676 | A * | 10/1991 | Shiina et al. | 271/121 |
| 6,830,244 | B2 * | 12/2004 | Komatsu | 271/10.01 |
| 2005/0062218 | A1 | 3/2005 | Murakami et al. | |
| 2007/0210512 | A1 | 9/2007 | Sakakibara et al. | |

FOREIGN PATENT DOCUMENTS

| | | | |
|---|---|---|---|
| JP | 60-009842 | U | 1/1985 |
| JP | 61-145739 | U | 9/1986 |
| JP | 4-292339 | A | 10/1992 |
| JP | 06-271100 | | 8/1994 |
| JP | 7-206203 | A | 8/1995 |
| JP | 2001-097575 | A | 4/2001 |
| JP | 2001-106347 | | 4/2001 |
| JP | 2005-075546 | A | 3/2005 |
| JP | 2007-0238252 | | 9/2007 |

OTHER PUBLICATIONS

JP Office Action dtd Jan. 5, 2010, JP Appln. 2008-078622, English translation.

* cited by examiner

*Primary Examiner* — Michael McCullough
(74) *Attorney, Agent, or Firm* — Banner & Witcoff, Ltd

(57) ABSTRACT

A document feeder includes a sheet tray loaded with sheets stacked thereon in a predetermined direction, a pickup unit pulling in sheets on the sheet tray and feed the sheets, a separation unit that separates a sheet from the sheets fed through the pickup unit and feeds the separated sheet, so as to convey the sheets sequentially on a sheet-by-sheet basis, and a guide unit that forms a carrying path extending from the sheet tray to the separation unit. The guide unit has an entrance portion provided at a side of the sheet tray relative to the separation unit, as an entrance of the sheets on the sheet tray into the carrying path. The carrying path has a longer length in the predetermined direction at a downstream side in a sheet carrying direction relative to the entrance portion than a length in the predetermined direction of the entrance portion.

18 Claims, 6 Drawing Sheets

DOCUMENT FEEDER AND IMAGE SCANNING DEVICE PROVIDED WITH THE SAME

CROSS-REFERENCE TO RELATED APPLICATION

This application claims priority under 35 U.S.C. §119 from Japanese Patent Application No. 2008-078622 filed on Mar. 25, 2008. The entire subject matter of the application is incorporated herein by reference.

BACKGROUND

1. Technical Field

The following description relates to one or more document feeders.

2. Related Art

A document feeder is a device configured to feed document sheets on a sheet-by-sheet basis from a stack of document sheets. For example, Japanese Patent Provisional Publication No. 2007-238252 discloses an Automatic Document Feeder (ADF), which includes a separation roller and a separation pad that are configured to separate and feed a sheet from two or more document sheets, and a pickup roller and a pickup arm that are configured to pull in sheets loaded on a document tray and feed the sheets to the separation roller.

Two or more sheets are separated from the sheets pulled in from the document tray at a pickup unit that includes the aforementioned pickup roller and pickup arm, and then conveyed to the separation roller. After that, the sheets separated are further separated by the separation roller and the separation pad, and thus fed into a scanner unit on a sheet-by-sheet basis.

SUMMARY

In the meantime, the maximum number (specified number) of document sheets that can be loaded on the document tray is determined based on a length in a height direction on a sheet carrying path (hereinafter, referred to as a height of the sheet carrying path) that extends from the document tray to the pickup unit. Specifically, the specified number of document sheets is determined based on the number of sheets that corresponds to the height of the sheet carrying path (hereinafter, referred to as a critical number) in view of a safety ratio.

Therefore, it is possible to load on the document tray document sheets more than the specified number. However, when document sheets more than the critical number are placed on the document tray and forcibly inserted into the pickup unit, a pressure at a contact surface between the sheets at the pickup unit attains an excessively high value and a plurality of sheets stick to each other under the pressure.

When a sheet feeding operation is performed under such a condition, the plurality of sheets are conveyed from the pickup unit to the separation unit in the state sticking to each other under the pressure. Therefore, the sticking sheets might not perfectly be separated by the separation unit, and thus it might result in a multiple feed in which some of the sticking sheets are fed together at a time in an overlapping state.

Even though such a multiple feed occurs, a user would visually feel as if the sheets were normally being fed. Therefore, compared with a problem that a paper jam occurs or the feeder fails to feed a sheet, the user is likely not to detect the multiple feed.

When such a problem that a paper jam occurs or the feeder fails to feed a sheet is caused, the user notices the occurrence of the problem and tries to resolve the problem, for example, by re-scanning the document. Accordingly, a fatal error can be avoided. On the other hand, in the case of the multiple feed, it is highly likely that the user does not notice that the multiple feed causes some sheets not to be scanned and thus it might lead to a fatal error.

Aspects of the present invention are advantageous to provide one or more improved document feeders and image scanning devices provided with the feeders that make it possible to prevent a multiple feed.

According to aspects of the present invention, a document feeder configured to feed a document sheet in a sheet carrying direction is provided, which document feeder includes a sheet tray configured to be loaded with sheets stacked thereon in a predetermined direction, a pickup unit configured to pull in sheets loaded on the sheet tray and feed the sheets forward in the sheet carrying direction, a separation unit configured to separate a sheet from the sheets fed through the pickup unit from the sheet tray and feed the separated sheet, so as to convey the sheets sequentially on a sheet-by-sheet basis, and a guide unit configured to form a carrying path which extends from the sheet tray to the separation unit. The guide unit has an entrance portion provided at a side of the sheet tray relative to the separation unit. The entrance portion is configured as an entrance of the sheets loaded on the sheet tray into the carrying path. The carrying path is configured to have a longer length in the predetermined direction at a downstream side in the sheet carrying direction relative to the entrance portion than a length in the predetermined direction of the entrance portion.

In some aspects of the present invention, the carrying path that extends from the sheet tray to the separation unit is configured to have a longer length in the predetermined direction (the stacked direction in which sheets are stacked on the sheet tray) at a downstream side in the sheet carrying direction relative to the entrance portion than a length in the predetermined direction of the entrance portion. Thereby, adhesion between sheets under pressure can be released at a downstream side in the sheet carrying direction relative to the entrance portion. Accordingly, it is possible to prevent an excessively high contact pressure between sheets, and thus to avoid a multiple feed in which two or more sheets are fed together at a time in a state sticking to each other.

When sheets more than the critical number are forcibly inserted, no sheet is fed along with a paper jam caused at the entrance portion, and thus no multiple feed occurs. Further, when sheets of such a large number as to avoid no sheet fed due to a paper jam are inserted, as mentioned above, the adhesion between sheets under pressure can be released at a downstream side in the sheet carrying direction relative to the entrance portion. Therefore, in this case, a multiple feed can be avoided.

Hence, in some aspects of the present invention, it is possible to prevent such a fatal error that a scanning operation is terminated without the user noticing the existence of document sheets to be scanned that have not yet been scanned.

According to aspects of the present invention, further provided is an image scanning device, which includes a document feeder configured to feed a document sheet in a sheet carrying direction, and a scanner configured to scan images on the document sheet fed by the document feeder. The document feeder includes a sheet tray configured to be loaded with sheets stacked thereon in a predetermined direction, a pickup unit configured to pull in sheets loaded on the sheet tray and feed the sheets forward in the sheet carrying direction, a separation unit configured to separate a sheet from the sheets fed through the pickup unit from the sheet tray and feed the separated sheet, so as to convey the sheets sequentially on a sheet-by-sheet basis, and a guide unit configured to form a carrying path which extends from the sheet tray to the separation unit. The guide unit has an entrance portion provided at a side of the sheet tray relative to the separation unit. The entrance portion is configured as an entrance of the sheets loaded on the sheet tray into the carrying path. The carrying path is configured to have a longer length in the predetermined direction at a downstream side in the sheet carrying direction relative to the entrance portion than a length in the predetermined direction of the entrance portion.

In some aspects of the present invention, the image scanning device configured as above can provide the same effects as those of the aforementioned document feeder.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct and that this specification is not intended to be limiting in this respect.

Hereinafter, an embodiment according to aspects of the present invention will be described with reference to the accompany drawings.

1. Outline Configuration of Scanning Device

Figure 1:
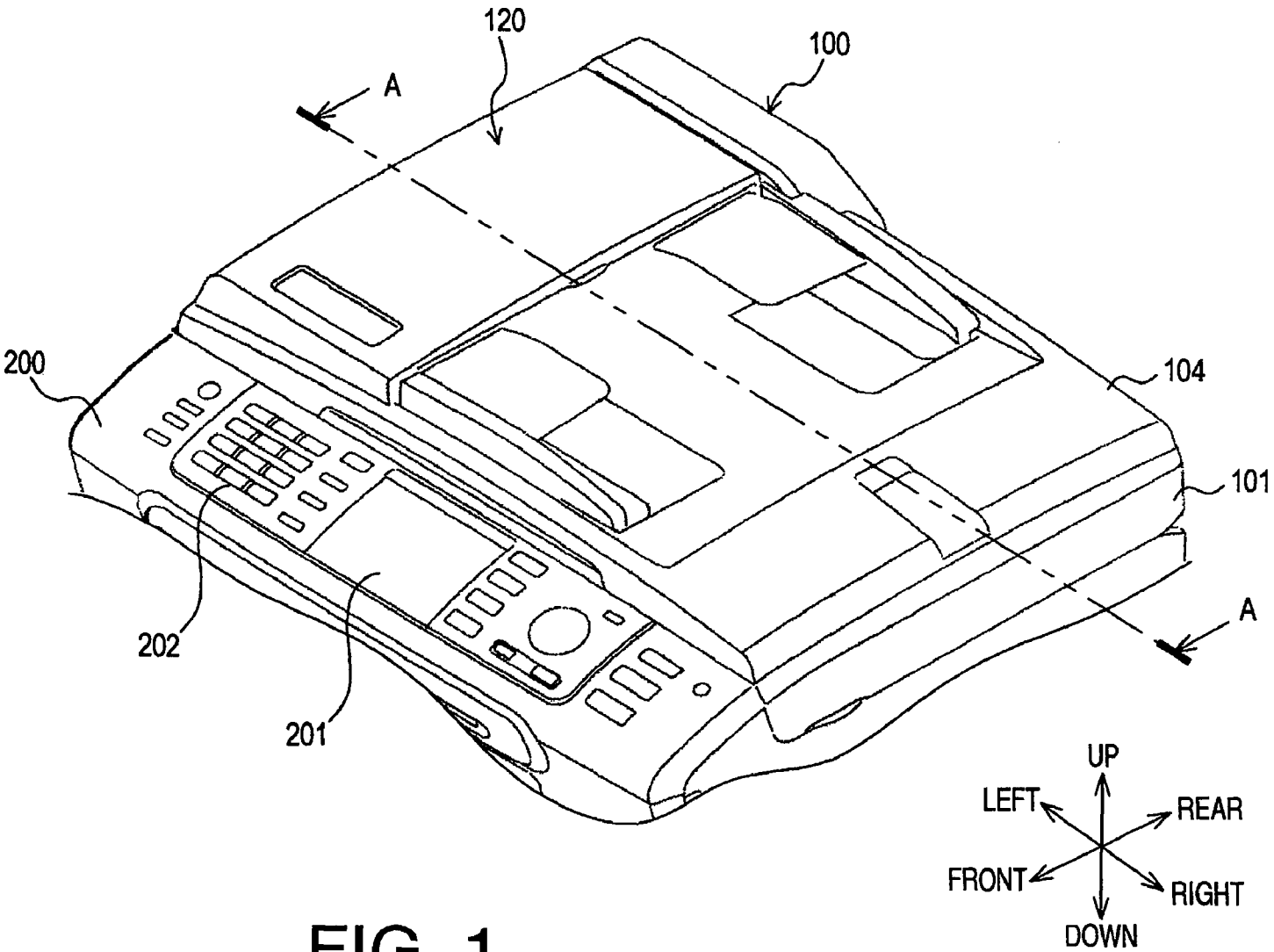
FIG. 1 is a perspective external view of an image scanning device when viewed from the top in an embodiment according to one or more aspects of the present invention.

As illustrated in FIG. 1, an image scanning device 100 of the embodiment has an operation panel 200 at a front side of a top surface thereof and a main unit 101 behind the operation panel 200. The operation panel is adopted to operate and set the image scanning device 100. The main unit 101 is adopted to perform an ADF scanning operation of scanning images on a document while automatically feeding the document and a static document scanning operation (flatbed scanning operation) of scanning images on a statically placed document.

The operation panel 200 has a display unit 201 adopted to display information such as settings and messages and key buttons 202 adopted to accept a user selection of a function and an optional setting.

Figure 2:
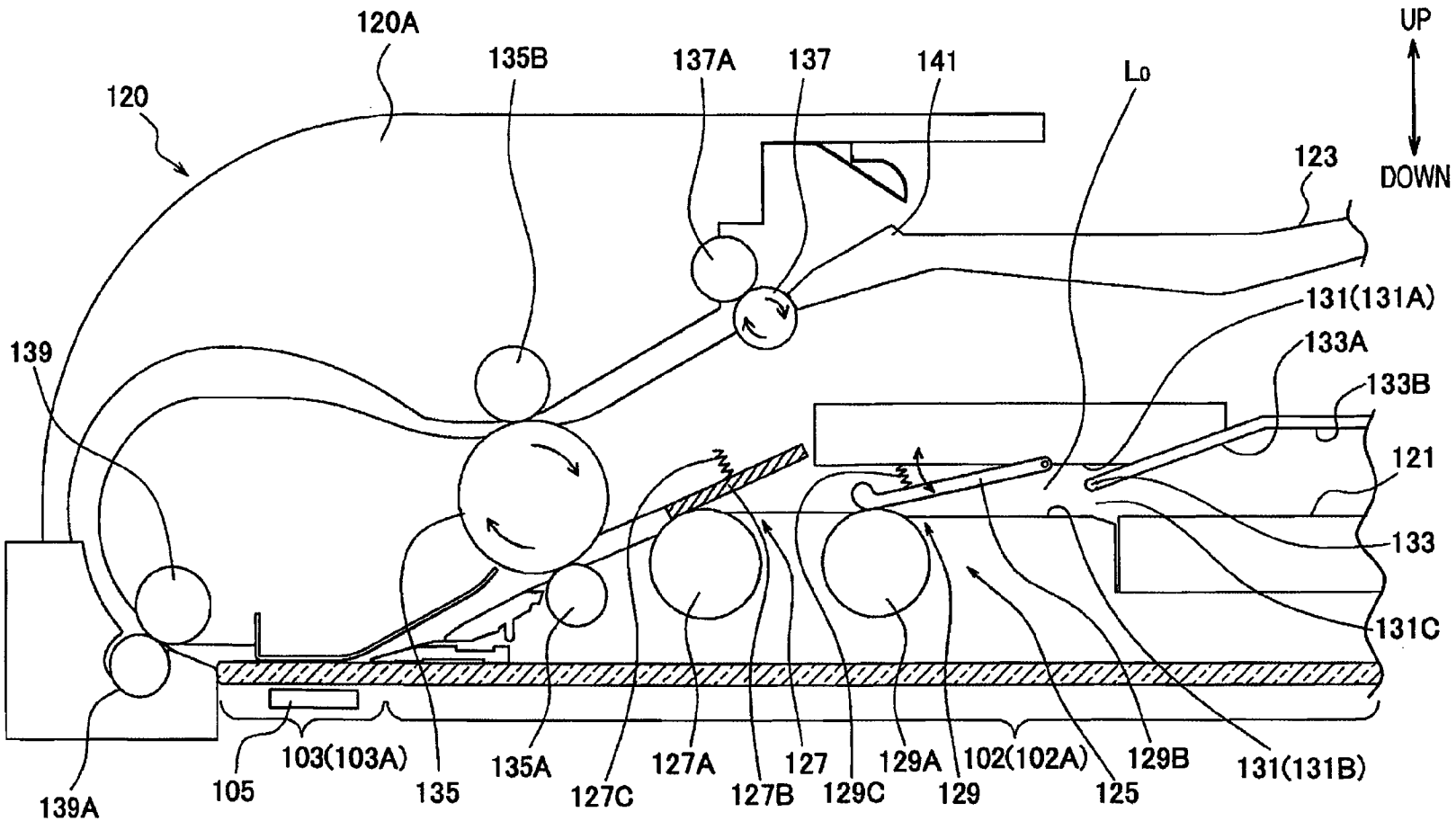
FIG. 2 is a cross-sectional view of the image scanning device along an A-A line shown in FIG. 1 in the embodiment according to one or more aspects of the present invention.

As illustrated in FIG. 2, the main unit 101 of the image scanning device 100 has an image scanning window 102 for the static document scanning operation (hereinafter referred to as a static scanning window 102), and an image scanning window 103 for the ADF scanning operation (hereinafter referred to as an automatic scanning window 103). Both of the scanning windows 102 and 103 are sealed with a platen 102A and a platen 103A, respectively, which platens are made of transparent material such as glass or acrylic.

A cover 104 (see FIG. 1) is swingably attached on the top surface side of the main unit 101. When a document is scanned through the static scanning window 102, the cover 104 is manually opened upward and the document to be scanned is placed on the static scanning window 102.

Inside the main unit 101, an image pickup device 105 is located, which is configured to receive light that is incident onto the document and then reflected by the document, and to generate electrical signals based on the received light. The image scanning device 100 scans the images on the document and converts the scanned image into the electrical signals through the image pickup device 105.

Here, in the embodiment, a Contact Image Sensor (CIS) is utilized as the image pickup device 105. Immediately beneath the scanning windows 102 and 103, the CIS (the image pickup device 105) has the longitudinal direction that corresponds to the direction perpendicular to the moving direction of the CIS and the vertical direction. Namely, the longitudinal direction of the CIS is perpendicular to FIG. 2.

The image pickup device 105 is attached to the main unit 101 movably in the longitudinal direction (the right-to-left direction in FIG. 2) of the main unit 101. In the ADF scanning operation, the image pickup device 105 stays just below the automatic scanning window 103 to scan the images. Meanwhile, in the static document scanning operation, the image pickup device 105 moves below the static scanning window 102 to scan the images.

In a region of the cover 104 above the automatic scanning window 103, an Automatic Document Feeder (ADF) 120 is provided, which is configured to feed document sheets to be scanned to the automatic scanning window 103.

2. Configuration of Automatic Document Feeder

A document tray 121 is a tray on which document sheets to be scanned is loaded. A catch tray 123, configured to be loaded with already-scanned document sheets thereon, is provided above the document tray 121. It is noted that, in the embodiment, sheets are stacked in the vertical direction on each of the document tray 121 and the catch tray 123. Namely, the thickness of the stacked sheets is defined as a length in the vertical direction of the stacked sheets.

Further, the document tray 121 and the catch tray 123 are placed in respective positions shifted in the horizontal direction (rightward in FIG. 2) from a region of the ADF 120 corresponding to the automatic scanning window 103 (hereinafter, which region will be referred to as a feeder main body 120A).

In addition, a feeder mechanism 125 is provided in a region of the document tray 121 on a side of the feeder main body 120A. The feeder mechanism 125 is configured to feed the document sheets loaded on the document tray 121, in sequence from a bottom sheet, to the automatic scanning window 103.

The feeder mechanism 125 includes a separation unit 127 configured to separate a plurality of document sheets conveyed from the document tray 121 and feed the document sheets on a sheet-by-sheet basis, and a pickup unit 129, provided on an upstream side in a sheet carrying direction relative to the separation unit 127, which pickup unit 129 is configured to pick up the document sheets loaded on the document tray 121 and feed the document sheets to the separation unit 127.

The separation unit 127 includes a separation roller 127A, a separation pad 127B, and a spring 127C. The separation roller 127A is configured to rotate in contact with a lower face of a document sheet and thus give a feed force to the document sheet. The separation pad 127B is movable to give a feed resistance to the document sheet through contact with an upper face of the document sheet. The spring 127C is configured to generate an elastic force to press the separation pad 127B toward the separation roller 127A.

The pickup unit 129 includes a pickup roller 129A, a movable arm 129B, and a spring 129C. Here, the pickup roller 129A is configured to rotate in contact with the document sheet and thus give a feed force to a document sheet. In addition, the movable arm 129B is configured to press a document sheet against the pickup roller 129A. Further, the spring 129C is configured to generate an elastic force to press the pickup arm 129A toward the pickup roller 125A.

Consequently, several document sheets are separated at the pickup unit 129 from a plurality of document sheets fed from the document tray 121 and conveyed to the separation unit 127. After that, one of the several document sheets, which is in contact with the separation roller 127A, is sent out from the separation unit 127.

At this time, the document sheets, which are placed closer to the separation pad 127B than the document sheet in contact with the separation roller 127A, receive a feed resistance from the separation pad 127B, and thus the feeding thereof are blocked. It follows that the document sheets loaded on the document tray 121 are sequentially fed to the automatic scanning window 103 on a sheet-by-sheet basis in order from a bottom sheet.

Figure 3:
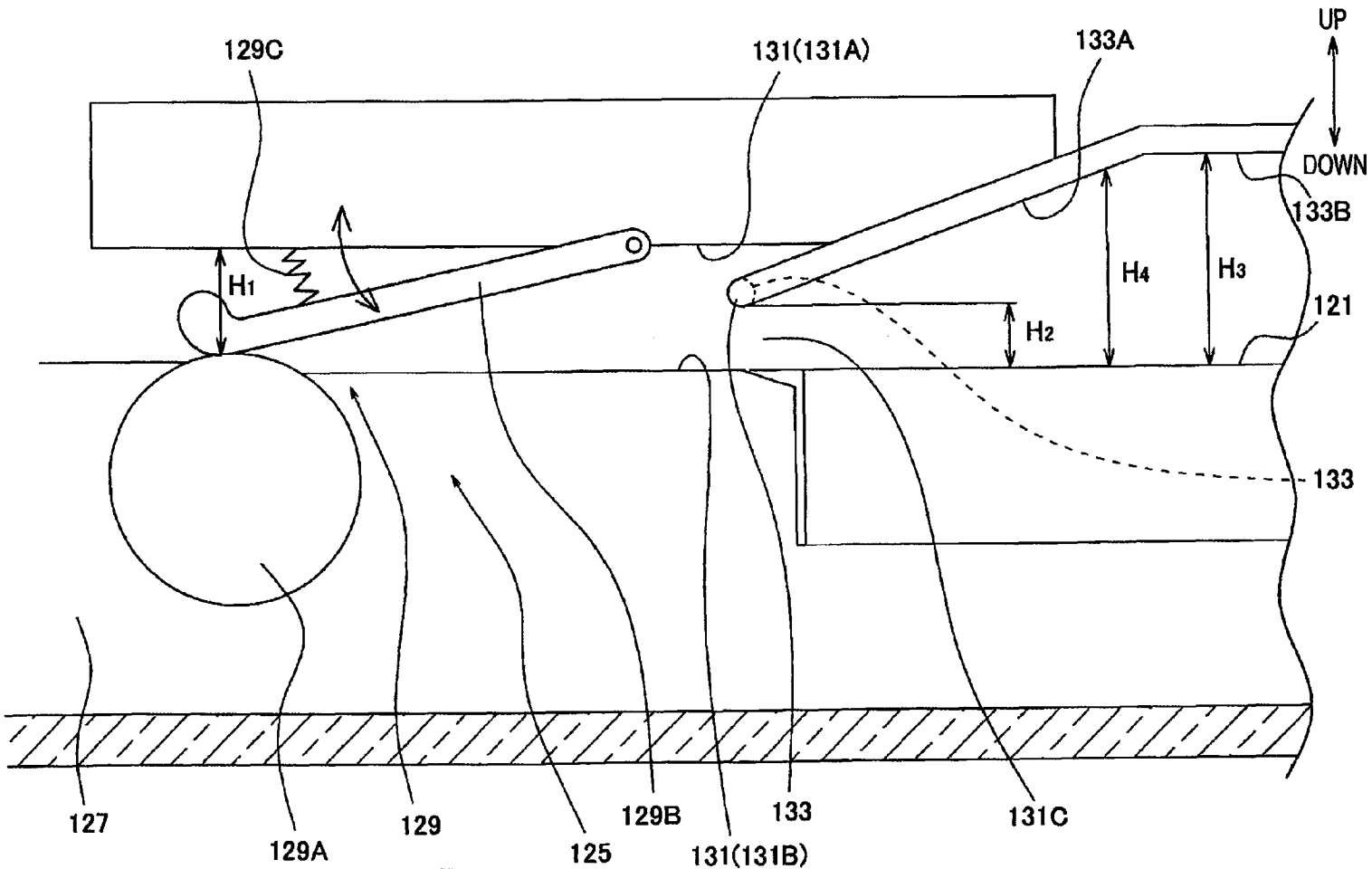
FIG. 3 is an enlarged view of an entrance portion on a sheet carrying path in the embodiment according to one or more aspects of the present invention.

As illustrated in FIG. 3, a guide unit 131, configured to form a sheet carrying path Lo extending from the document tray 121 to the separation unit 127, includes a first guide unit 131A provided at an upper side and a second guide unit 131B provided at a lower side.

Here, the first guide unit 131A is configured with a plurality of guide ribs extending in a sheet carrying direction (the right-to-left direction in FIG. 3) in which a document sheet is carried. Meanwhile, the second guide unit 131B is configured with a horizontally extending planer member. Further, in the embodiment, the document tray 121 and the second guide unit 131B are configured to have level top surfaces of a substantially identical height.

Figure 4:
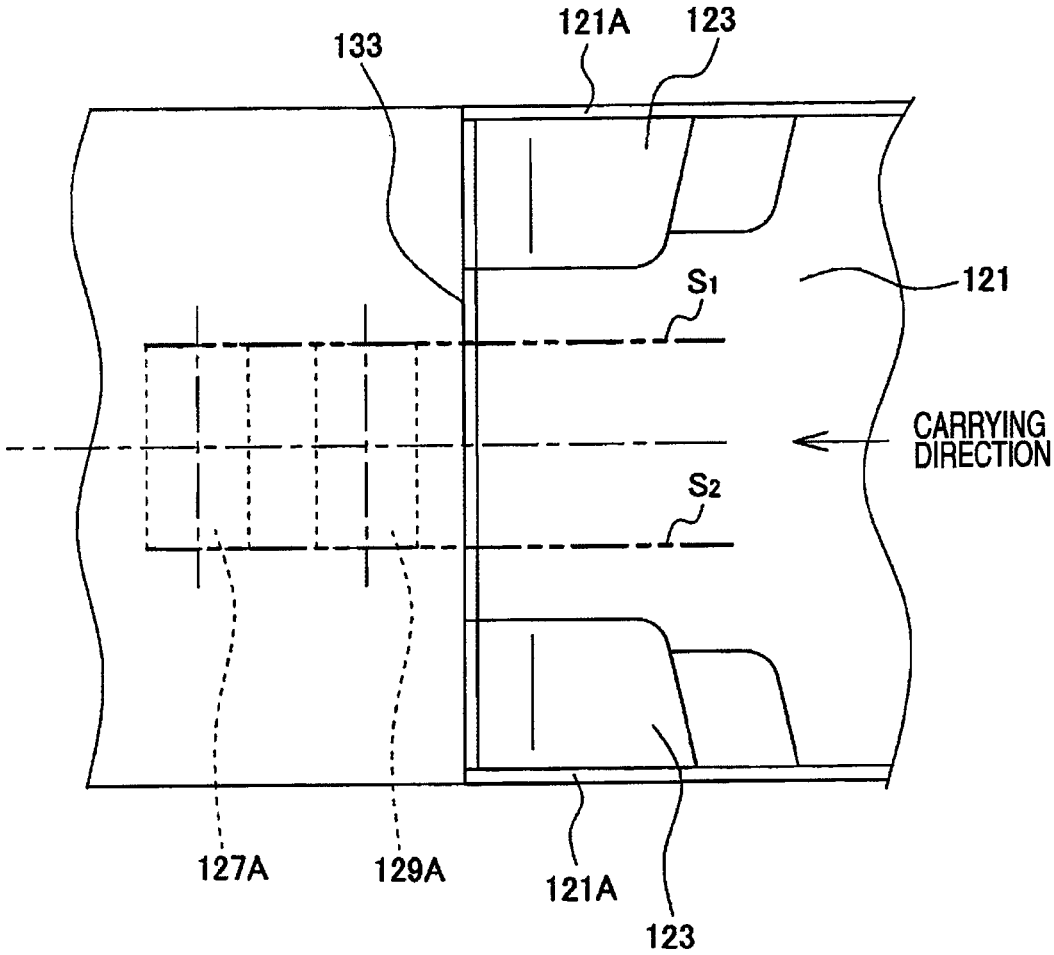
FIG. 4 is a top view showing a positional relationship between a pickup roller and a regulating member in the embodiment according to one or more aspects of the present invention.

A regulating member 133 is provided at an entrance portion 131C located at a side of the document tray 121 on the sheet carrying path Lo, and configured to define an end (an upper end in the embodiment) of the entrance portion 131C in the vertical direction. As illustrated in FIG. 4, the regulating member 133 is configured to connect a pair of side guides 121A as a bridge between the side guides 121A.

As illustrated in the FIG. 4, in the embodiment, at least part of the regulating member 133 is between a first virtual plane S1 and a second virtual plane S2. It is noted that the first virtual plane S1 is defined to be a plane which includes one end portion of the pickup roller 129A in an axial direction of the pickup roller 129A and which is perpendicular to the axial direction of the pickup roller 129A. Further, the second virtual plane S2 is defined to be a plane which includes the other end portion of the pickup roller 129A in the axial direction of the pickup roller 129A and which is perpendicular to the axial direction of the pickup roller 129A.

In the embodiment, the side guides 121A are designed to guide a document sheet to be fed in contact with both ends in a width direction of the document sheet. The side guides 121A are attached movably in the width direction relative to the document tray 121. It is noted that the width direction is defined as a direction perpendicular to the sheet carrying direction and the direction (stacked direction) in which sheets are stacked on the document tray 121.

As illustrated in FIG. 3, the regulating member 133 is configured so that a length H1 in a height direction of the pickup unit 129, that is, the distance between the pickup roller 129A and the first guide unit 131A is longer than a length H2 in the height direction of the entrance portion 131C. Further, the regulating member 133 includes a guide cover 133A configured to extend from the regulating member 133 toward the document tray 121.

It is noted that the "height direction of the entrance portion 131C and the sheet carrying path Lo" represents a direction parallel to a direction in which document sheets are stacked on the document tray 121. In the embodiment, since document sheets are stacked in the vertical direction, the "height direction of the entrance portion 131C or the sheet carrying path Lo" denotes the vertical direction.

The guide cover 133A includes a protective cover 133B provided above the document tray 121 to extend toward the document tray 121 (rightward in FIG. 3) and cover the document sheets loaded on the document tray 121 from an upper side opposite the document tray 121 via the document sheets.

A distance H3 between the document tray 121 and the protective cover 133B is configured to be longer than the length H2 in the height direction of the entrance portion 131C. Thus, the guide cover 133A, which is configured to connect the entrance portion 131C and the protective cover 133B, is slanted relative to the sheet carrying direction.

Namely, a height H4 from the document tray 121 to the guide cover 133A is designed to become smaller from the protective cover 133B toward the entrance portion 131C. Therefore, the document sheets loaded on the document tray 121 are guided by the guide cover 133A to be fed to the entrance portion 131C.

As illustrated in FIG. 2, a first feed roller 135, provided at a downstream side in the sheet carrying direction relative to the separation unit 127, rotates in contact with the document sheet at a lower end thereof, and thus feeds the document sheet conveyed by the separation roller 127A toward the automatic scanning window 103. Meanwhile, the first feed roller 135 rotates in contact with the document sheet at an upper end thereof, and thus feeds to a discharge roller 137 the document sheet that has passed through the automatic scanning window 103.

A pinch roller 135A and a pinch roller 135B are press rollers configured to press a document sheet against the first feed roller 135. A pinch roller 137A is a press roller configured to press a document sheet against the discharge roller 137. The pinch rollers 135A, 135B, and 137A are adopted to be driven to rotate along with contact with a document sheet being conveyed.

A second feed roller 139 is provided away from the platen 103A, at a downstream side in the sheet carrying direction relative to the automatic scanning window 103. The second feed roller 139 is configured to feed a document sheet that has passed through the automatic scanning window 103 toward the catch tray 123. The document sheet fed upward from the second feed roller 139 is turned around substantially 180 degrees by a guide member (not shown), and thereafter discharged toward the catch tray 123.

A pinch roller 139A is a press roller configured to press a document sheet against the second feed roller 139. The pinch roller 139A is driven to rotate along with contact with a document sheet being conveyed. The catch tray 123 includes a protruding portion 141 formed at a side of the discharge roller 137. The protruding portion 141 is configured to insert a document sheet discharged from the discharge roller 137 between the catch tray 123 and the document sheets already placed on the catch tray 123.

Figure 5:
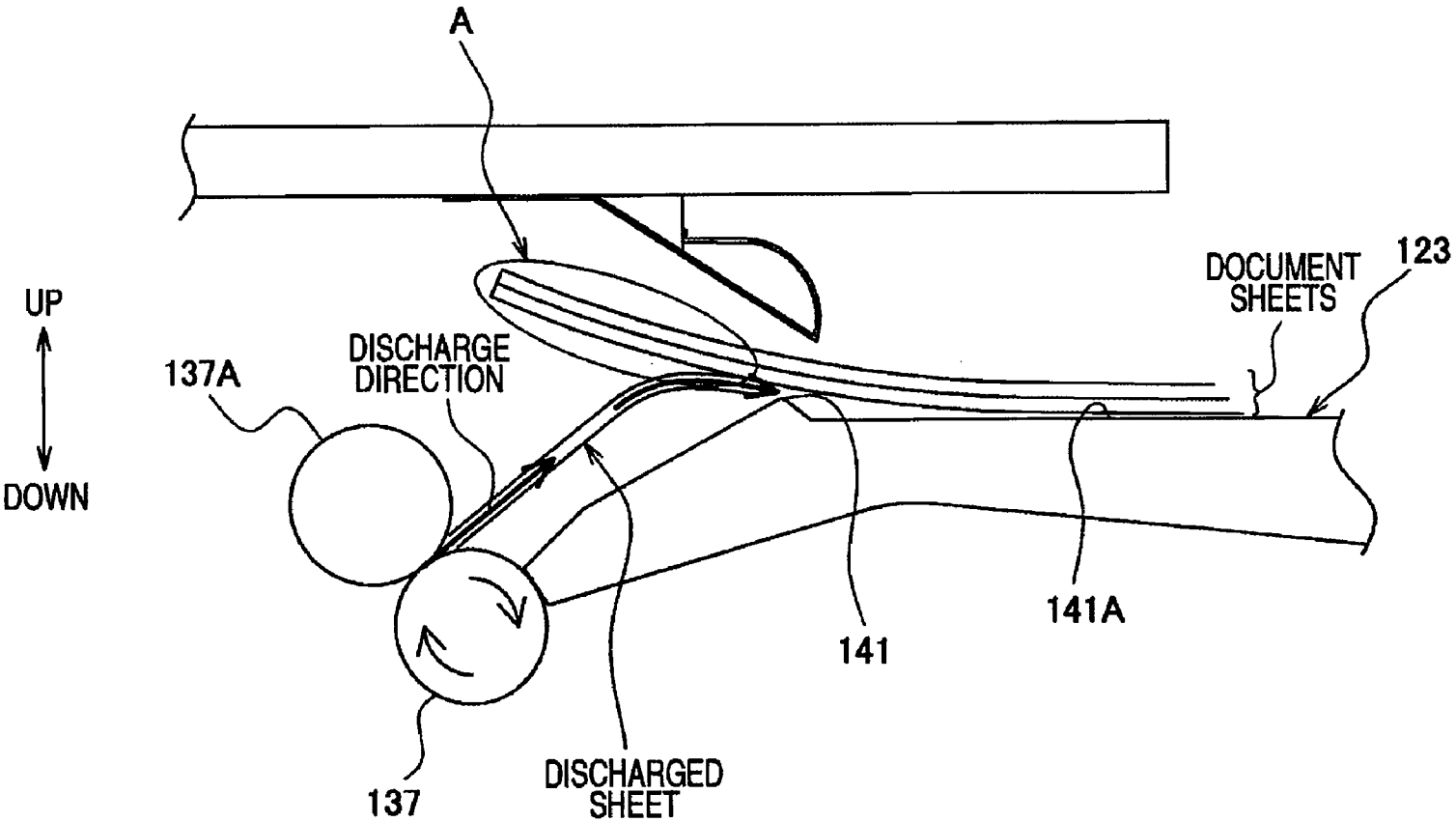
FIG. 5 is an enlarged view of a region around a discharge roller 137 and a protruding portion 141 in the embodiment according to one or more aspects of the present invention.

As illustrated in FIG. 5, the protruding portion 141 is configured to lift an end portion (a portion A in FIG. 5) at the discharge roller 137 side of the document sheets placed on the catch tray 123. Thereby, the document sheet discharged from the discharge roller 137 is made collide against the aforementioned end portion, lifted by the protruding portion 141, of the document sheets on the catch tray 123.

More specifically, the document sheet discharged from the discharge roller 137 collides at an acute angle against an end portion (a portion A in FIG. 5) of a bottom face of a bottom one of the document sheets on the catch tray 123, which end portion is closer to the discharge roller 137 than the protruding portion 141. Thereafter, the sheet carrying direction is turned into a direction along a flat part 141A. Thus, the document sheet discharged from the discharge roller 137 is placed on the catch tray 123 so as to slide between the catch tray 123 and the document sheets already loaded on the catch tray 123.

3. Outline Operation of ADF

After a scanning start button (not shown) is pressed in a state where a plurality of document sheets are placed on the document tray 121 with the scanned surfaces down, a driving motor (not shown) begins to rotate. Thereby, the document sheets placed on the document tray 121 are conveyed to the automatic scanning window 103 sequentially in order from a bottom sheet in a stacked direction of the document sheets stacked on the document tray 121, and a scanning operation is launched.

Figure 6:
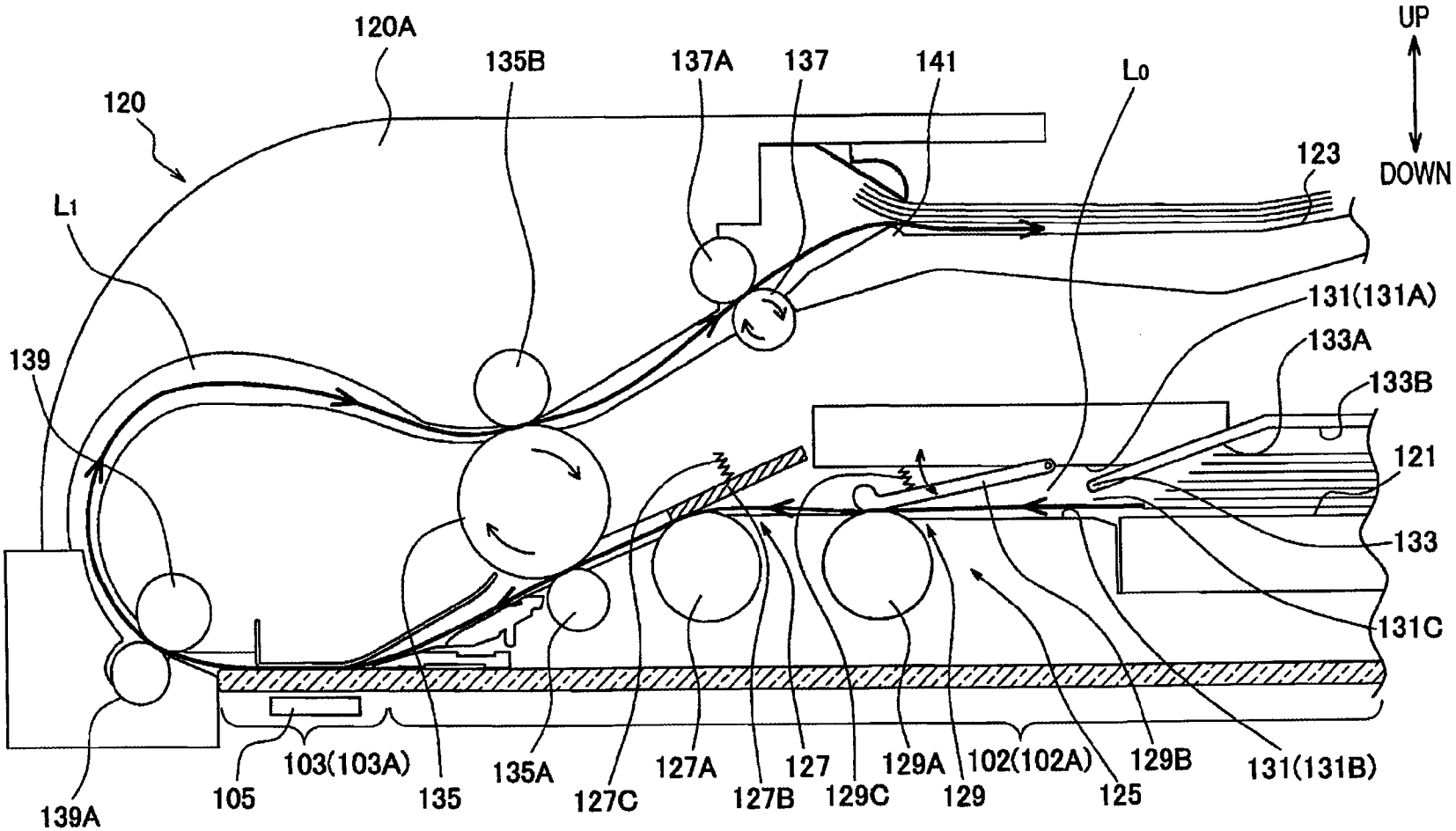
FIG. 6 is a cross-sectional view of the image scanning device to show how a document sheet is conveyed in the embodiment according to one or more aspects of the present invention.

As indicated by thick arrows in FIG. 6, the document sheet completely scanned is conveyed from the discharge roller 137 to the catch tray 123 via the sheet carrying path Lo and a sheet carrying path L1. Then, the document sheet discharged is sequentially loaded on the catch tray 123 so as to slide below a bottom one in a stacked direction of the document sheets already stacked on the catch tray 123.

In the embodiment, document sheets completely scanned are stacked from upside to downside with the scanned surfaces up in sequence the scanning is completed. Accordingly, the document sheets stacked on the document tray 121 are placed on the catch tray 123 with the scanned faces upside down.

4. Futures of Image Scanner (ADF)

In the embodiment, the length H1 in the height direction of the pickup unit 129 is configured to be longer than the length H2 in the height direction of the entrance portion 131C. Thus adhesion between document sheets under pressure can be released at a downstream side in the sheet carrying direction relative to the entrance portion 131C. Therefore, it is possible to prevent the pressure at a contact surface between document sheets from attaining an excessively high value at the pickup unit 129. Thus, it is possible to avoid a multiple feed in which two or more document sheets are fed together at a time in a state sticking to each other.

Further, when document sheets more than the critical number of sheets are forcibly inserted, no sheet is fed because the document sheets jam at the entrance portion 131C, yet of cause a multiple feed does not occur. Additionally, when document sheets of such a number as to avoid the problem that no sheet is fed are inserted, as described above, the adhesion caused between document sheets under pressure is released at a downstream side on the sheet carrying path Lo relative to the entrance portion 131C. Thus, it is possible to avoid a multiple feed.

Thus, in the embodiment, it is possible to prevent such a fatal error that a scanning operation is terminated without the user noticing the existence of document sheets to be scanned that have not yet been scanned. Further, in the embodiment, at an upstream side in the sheet carrying direction relative to the entrance portion 131C, the guide cover 133A is provided to guide the document sheets placed on the document tray 121 to the entrance portion 131C. Thereby, the user can easily place and insert document sheets.

Further, in this embodiment, the protective cover 133B is attached to the guide cover 133A, and the length H3 in the height direction from the document tray 121 to the protective cover 133B is longer than the length H1 in the height direction at the entrance portion 131C. Thus, the user can easily place and insert document sheets, even though the document sheets are bent.

In the meantime, a document sheet pulled in at the pickup unit 129 is conveyed in contact with the pickup roller 129A and the regulating member 133. Therefore, when a contact portion between the pickup roller 129A and the document sheet and a contact portion between the regulating member 133 and the document sheet are shifted mutually and significantly, relative to the sheet carrying direction, in a direction perpendicular to the sheet carrying direction, the document sheet might be conveyed in a state skewed relative to the sheet carrying direction.

In the embodiment, however, as illustrated in FIG. 4, at least part of the regulating member 133 is between the first virtual plane S1 and the second virtual plane S2. Accordingly, the contact portion between the pickup roller 129A and the document sheet and the contact portion between the regulating member 133 and the document sheet are not significantly shifted relative to the sheet carrying direction, in the direction perpendicular to the sheet carrying direction. Thus, the document sheet can be prevented from being conveyed in a state skewed relative to the sheet carrying direction.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of its versatility are shown and described in the present disclosure. It is to be understood that the present invention is capable of use in various other combinations and environments and is capable of changes or modifications within the scope of the inventive concept as expressed herein. For example, the following modifications are possible.

(Modifications)

In the aforementioned embodiment, the rollers 129A and 127A are provided at the pickup unit 129 and the separation unit 127, respectively. However, the rollers 129A and 127A may be configured with only a single roller. In this case, the removable arm 129B may be removed.

In the aforementioned embodiment, the catch tray 123 is provided above the document tray 121. However, the present invention is not limited to this configuration. Further, in the aforementioned embodiment, the ADF 120 is employed which is configured to be loaded with document sheets stacked in the vertical direction with the scanned surfaces of the sheets down. However, aspects of the present invention may be applied to an ADF 120 configured to be loaded with document sheets stacked with the scanned surfaces of the sheets up.

In the aforementioned embodiment, the ADF 120 is capable only of single-side scanning. However, aspects of the present invention may be applied to an ADF capable of double-side scanning.

In the aforementioned embodiment, the ADF 120 has a document discharging manner adopted to discharge a document sheet below a bottom sheet of document sheets already placed on the catch tray 123. However, aspects of the present invention may be applied to an ADF 120 having a document discharging manner adopted to discharge a document sheet on a top sheet of document sheets already placed on the catch tray, or may be applied to an ADF 120 capable of both the document discharging manners.

In the aforementioned embodiment, the top surfaces spanning from the document tray 121 to the pickup unit 129 are configured to be substantially level. However, the top surfaces may not be level, and a stacked direction in which document sheets are stacked on the document tray 121 may be slanted.

In the aforementioned embodiment, the regulating member 133 is provided only at the upper end of the entrance portion 131C of the sheet carrying path Lo. However, another regulating member may be provided at a lower end of the entrance portion 131C.

In the aforementioned embodiment, since document sheets are stacked in the vertical direction, the height directions of the entrance portion 131C and the sheet carrying path Lo are identical to the vertical direction. However, in the above description, "the height directions of the entrance portion 131C and the sheet carrying path Lo" are intended to represent a direction parallel to the stacked direction in which document sheets are stacked. Therefore, for example, when a stacked direction in which document sheets are stacked is the horizontal direction, "the height directions of the entrance portion 131C and the sheet carrying path Lo" are defined as the horizontal direction.

In the aforementioned embodiment, a length in the height direction of a portion on the sheet carrying path Lo at a downstream side in the sheet carrying direction relative to the entrance portion 131C is longer than the length in the height direction of the entrance portion 131C. Here, a portion compared with the entrance portion 131C with respect to the length in the height direction is not limited to the pickup unit 129 that has the minimum length in the height direction on the sheet carrying path Lo. Any portion may be compared with the entrance portion 131C as long as the portion is located at a downstream side in the sheet carrying direction relative to the entrance portion 131C.

What is claimed is:

1. A document feeder configured to feed a document sheet in a sheet carrying direction, comprising:

a sheet tray configured to be loaded with sheets stacked thereon in a predetermined direction;

a pickup unit configured to pull in sheets loaded on the sheet tray and feed the sheets forward in the sheet carrying direction;

a separation unit configured to separate a sheet from the sheets fed through the pickup unit from the sheet tray and feed the separated sheet, so as to convey the sheets sequentially on a sheet-by-sheet basis; and a guide unit configured to form a carrying path which extends from the sheet tray to the separation unit, the guide unit having an entrance portion provided upstream in the sheet carrying direction relative to the pickup unit and the separation unit, the entrance portion being configured as an entrance of the sheets loaded on the sheet tray into the carrying path, and the carrying path having a first length in the predetermined direction within a range from a downstream side relative to the entrance portion to the pickup unit in the sheet carrying direction, the first length being longer than a second length in the predetermined direction at the entrance portion, one end of the first length in the predetermined direction being defined by the guide unit.

2. The document feeder according to claim 1, wherein the separation unit comprises:

a separation roller configured to rotate in contact with a first surface of the sheet and provide a feed force to the sheet; and a separation pad configured to contact a second surface, which is an opposite surface to the first surface of the sheet, and provide a feed resistance to the sheet.

3. The document feeder according to claim 1, wherein the pickup unit comprises:

a pickup roller configured to rotate in contact with the sheet and provide a feed force to the sheet; and a pickup arm configured to press the sheet against the pickup roller.

4. The document feeder according claim 3, further comprising:

a side guide provided to the sheet tray, the side guide being configured to guide the sheet placed on the sheet tray in the sheet carrying direction while contacting an end of the sheet in a sheet width direction that is perpendicular to the sheet carrying direction and the predetermined direction; and a regulator provided to the side guide, the regulator being configured to form an end of the entrance in the predetermined direction.

5. The document feeder according to claim 4, wherein at least part of the regulator is located between a first virtual plane and a second virtual plane, the first virtual plane being defined as a plane perpendicular to an axial direction of the pickup roller and includes a first end of the pickup roller in the axial direction, the second virtual plane being defined as a plane perpendicular to the axial direction of the pickup roller and includes a second end different from the first end of the pickup roller in the axial direction.

6. The document feeder according to claim 1, further comprising a guide member provided at an upstream side in the sheet carrying direction relative to the entrance portion, the guide member being configured to guide the sheets on the sheet tray to the entrance portion.

7. The document feeder according to claim 6, wherein the guide member comprises a cover configured to cover the sheet on the tray from an opposite side to the sheet tray via the sheets on the tray, and wherein a portion defined between the sheet tray and the cover is longer in the predetermined direction than the entrance portion.

8. The document feeder according claim 1, further comprising:

a side guide provided to the sheet tray, the side guide being configured to guide the sheet placed on the sheet tray in the sheet carrying direction while contacting an end of the sheet in a sheet width direction that is perpendicular to the sheet carrying direction and the predetermined direction; and a regulator provided to the side guide, the regulator being configured to form an end of the entrance in the predetermined direction.

9. The document feeder according to claim 1, wherein the carrying path is configured to have the first length in the predetermined direction at the pickup unit that is disposed at the downstream side in the sheet carrying direction relative to the entrance portion, the first length being longer than the second length in the predetermined direction at the entrance portion.

10. An image scanning device, comprising:

a document feeder configured to feed a document sheet in a sheet carrying direction on a sheet carrying path; and a scanner configured to scan images on the document sheet fed by the document feeder, wherein the document feeder comprises a sheet tray configured to be loaded with sheets stacked thereon in a predetermined direction;

a pickup unit configured to pull in sheets loaded on the sheet tray and feed the sheets forward in the sheet carrying direction;

a separation unit configured to separate a sheet from the sheets fed through the pickup unit from the sheet tray and feed the separated sheet, so as to convey the sheets sequentially on a sheet-by-sheet basis; and a guide unit configured to form a carrying path which extends from the sheet tray to the separation unit, the guide unit having an entrance portion provided upstream in the sheet carrying direction relative to the pickup unit and the separation unit, the entrance portion being configured as an entrance of the sheets loaded on the sheet tray into the carrying path, and the carrying path having a first length in the predetermined direction within a range from a downstream side relative to the entrance portion to the pickup unit in the sheet carrying direction, the first length being longer than a second length in the predetermined direction at the entrance portion, one end of the first length in the predetermined direction being defined by the guide unit.

11. The image scanning device according to claim 10, wherein the separation unit comprises:

a separation roller configured to rotate in contact with a first surface of the sheet and provide a feed force to the sheet; and a separation pad configured to contact a second surface, which is an opposite surface to the first surface of the sheet, and provide a feed resistance to the sheet.

12. The image scanning device according to claim 10, wherein the pickup unit comprises:

a pickup roller configured to rotate in contact with the sheet and provide a feed force to the sheet; and a pickup arm configured to press the sheet against the pickup roller.

13. The image scanning device according claim 12, wherein the document feeder further comprises:

a side guide provided to the sheet tray, the side guide being configured to guide the sheet placed on the sheet tray in the sheet carrying direction while contacting an end of the sheet in a sheet width direction that is perpendicular to the sheet carrying direction and the predetermined direction; and a regulator provided to the side guide, the regulator being configured to form an end of the entrance in the predetermined direction.

14. The image scanning device according to claim 13, wherein at least part of the regulator is located between a first virtual plane and a second virtual plane, the first virtual plane being defined as a plane perpendicular to an axial direction of the pickup roller and includes a first end of the pickup roller in the axial direction, the second virtual plane being defined as a plane perpendicular to the axial direction of the pickup roller and includes a second end different from the first end of the pickup roller in the axial direction.

15. The image scanning device according to claim 10, wherein the document feeder further comprises a guide member provided at an upstream side in the sheet carrying direction relative to the entrance portion, the guide member being configured to guide the sheets on the sheet tray to the entrance portion.

16. The image scanning device according to claim 15, wherein the guide member comprises a cover configured to cover the sheet on the tray from an opposite side to the sheet tray via the sheets on the tray, and wherein a portion defined between the sheet tray and the cover is longer in the predetermined direction than the entrance portion.

17. The image scanning device according claim 10, wherein the document feeder further comprises:

a side guide provided to the sheet tray, the side guide being configured to guide the sheet placed on the sheet tray in the sheet carrying direction while contacting an end of the sheet in a sheet width direction that is perpendicular to the sheet carrying direction and the predetermined direction; and a regulator provided to the side guide, the regulator being configured to form an end of the entrance in the predetermined direction.

18. The image scanning device according to claim 10, wherein the carrying path is configured to have the first length in the predetermined direction at the pickup unit that is disposed at the downstream side in the sheet carrying direction relative to the entrance portion, the first length being longer than the second length in the predetermined direction at the entrance portion.

* * * * *